US006634416B1

(12) United States Patent
Poloni et al.

(10) Patent No.: US 6,634,416 B1
(45) Date of Patent: Oct. 21, 2003

(54) DEVICE AND PROCESS FOR FAST CHANGING OF PARTS OF THE BAR GUIDE IN CONTINUOUS-CASTING PLANTS

(75) Inventors: Alfredo Poloni, Fogliano Redipuglia (IT); Massimo Maurizio, Trieste (IT); Michele Meret, Rivignano (IT)

(73) Assignee: Danieli & C Officine Meccaniche S.p.A., Buttrio (IT)

( * ) Notice: Subject to any disclaimer, the term of this patent is extended or adjusted under 35 U.S.C. 154(b) by 0 days.

(21) Appl. No.: 09/584,824

(22) Filed: May 31, 2000

(30) Foreign Application Priority Data

May 31, 1999 (IT) ..... MI99A001216

(51) Int. Cl.[7] ..... B22D 11/128

(52) U.S. Cl. ..... 164/484; 164/417; 164/476; 164/477; 164/442; 164/448

(58) Field of Search ..... 164/476, 477, 164/417, 418, 459, 484, 413, 442, 441, 447, 448

(56) References Cited

U.S. PATENT DOCUMENTS 3,783,934 A * 1/1974 Golde et al. ..... 164/282
4,428,415 A * 1/1984 Scheurecker et al. ..... 164/448
4,440,211 A * 4/1984 Ono
5,915,460 A * 6/1999 Courson et al. ..... 164/484

FOREIGN PATENT DOCUMENTS

GB 1243757 * 8/1971
IT 1214180 * 4/1987

OTHER PUBLICATIONS

The Making, Shaping and Treating if Steel, McGannon, 1964, United States Steel Corporation, Eight Edition, p. 665.*

* cited by examiner

*Primary Examiner*—M. Alexandra Elve
*Assistant Examiner*—Kevin McHenry
(74) *Attorney, Agent, or Firm*—Abelman, Frayne & Schwab

(57) ABSTRACT

In a continuous-casting plant, the segments of the guide for the casting bar are replaced rapidly, at least in part, using a two-station system, at least one of which stations being mobile, so as to be able to align head on a platform provided with means for hooking and extracting the said guide with the structure containing the guide itself. Once this alignment is obtained, the guide is displaced from one station to the other, its segments are replaced, and the guide is brought back into the original position.

26 Claims, 4 Drawing Sheets

FIG. 4
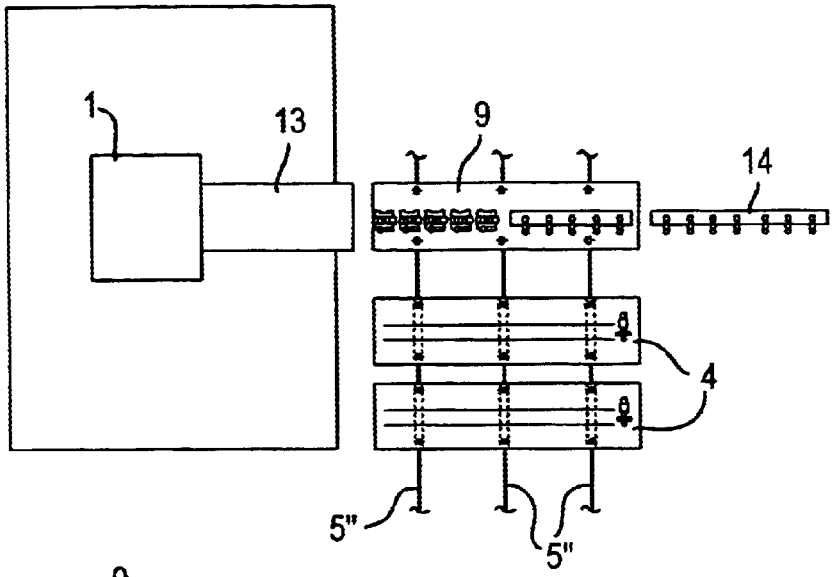
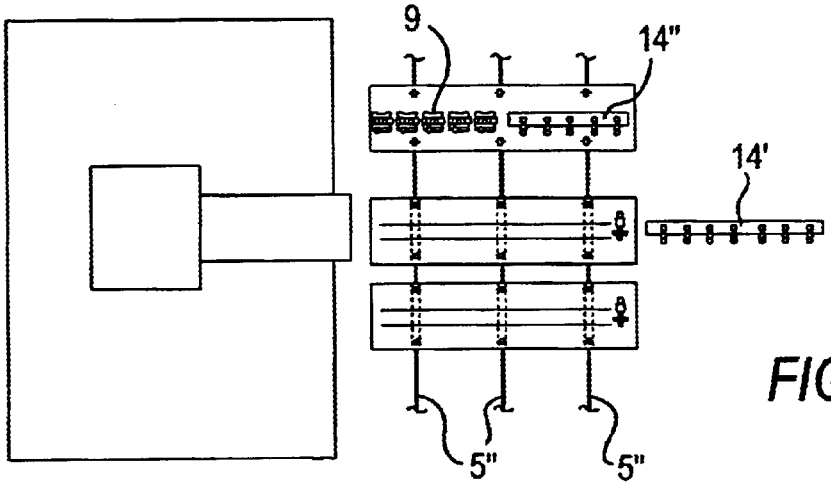
FIG. 5
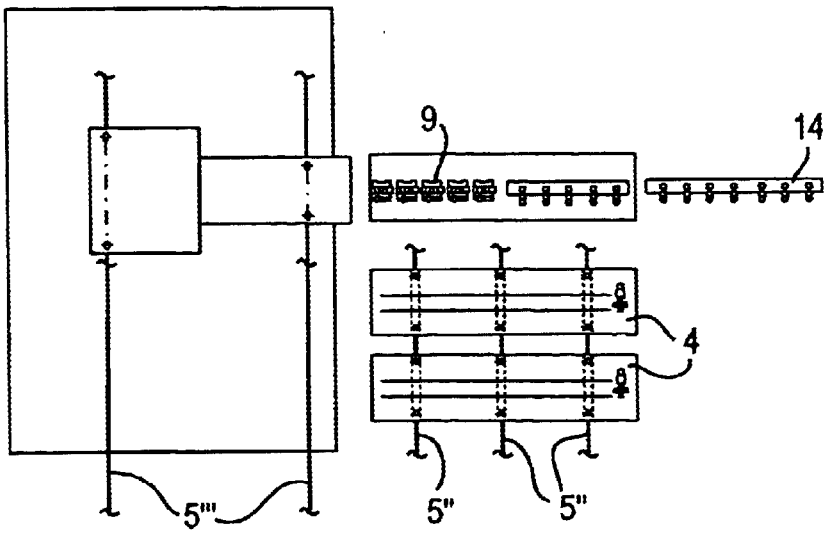
FIG. 6

DEVICE AND PROCESS FOR FAST CHANGING OF PARTS OF THE BAR GUIDE IN CONTINUOUS-CASTING PLANTS

FIELD OF INVENTION

The present invention refers to a device for fast changing of parts of the guide for the continuously cast product, hereinafter referred to as bar, and in particular to a device that enables at least some parts of the bar's guide to be changed in a fast and safe way in continuous-casting plants, advantageously but not exclusively connected directly to a rolling line; the invention also refers to a process for said fast change utilising the device mentioned above.

STATE OF THE ART

Continuous-casting lines have for some time now replaced ingot casting in metallurgy, and in particular iron metallurgy, for the production of the so-called flat and long products, with numerous advantages linked, for example, to fewer processing rejects, a more homogeneous quality of the products, and greater productivity of the plants.

More recently, the so-called continuous-rolling technique has begun to assert itself, according to which the semi-finished product or bar, instead of being extracted from the continuous casting machine, sent to a parking area to await subsequent processing, cooled, checked for the presence and elimination of surface flaws, re-heated and finally hot-rolled, is sent from the continuous-casting plant to the rolling plant, either directly or after prior temperature maintenance and equalization treatment. Obviously, continuous rolling brings further advantages in terms of productivity and energy saving.

But along the above advantages, numerous drawbacks or technical requirements may arise that nullify the advantages obtained. For instance, both the natural wear of the bar guide and its damage due to accidents, such as liquid steel spilling due to bar breakdown, or the need to change the dimensions of the cast and/or the ingot mould impose stoppages of the continuous-casting plant and frequently also of the rolling plant.

Numerous solutions to the problem of replacing the bar guide as output from the ingot mould have been proposed; a first one consists in using a number of casting lines so as to ensure having at least one line always operating The British Patent No. 1 243 757 describes a plant in which two assemblies, each comprising a casting ingot mould and guides for the cast body, may be displaced transversely so as to set one of the assemblies alternately in line with a railing mill. In the same way, in the French Patent Applications 2 126 924 and 2 334 448, plants are described comprising two mobile stations, each bearing an ingot mould and at least part of the guide connected to the ingot mould, said stations being mobile transversely so as to be positioned, respectively, inside and outside the casting area.

Such solutions are, obviously, costly and complex, and frequently not suitable for many small and medium-to-small industrial situations. It has also been proposed, in the Italian Patent No. 1 214 180 in the name of the present applicant, to set up beforehand just one second guide for the continuously cast product, which can replace the guide currently being used, when this is either damaged or worn Out. In the patent cited, however, no means and/or processes are indicated for carrying out a fast change.

In any case, the setting-up of a second complete guide is a costly solution, albeit not as costly as the solution that envisages a number of casting lines.

SUMMARY OF THE INVENTION

The present invention proposes to get round the drawbacks referred to above by supplying a device used in the continuous casting of metals for fast replacement of at least part of the bar guide.

The present invention also proposes to provide a process for fast changing of at least part of said guide.

According to the present invention, in a continuous-casting plant comprising a casting station, an assembly made up of segments for guiding and cooling the bar, and an assembly for extracting and straightening the bar itself, a device for fast changing of the bar guide is provided which comprises a first station and a second station, at least one of which is provided with displacement means, for example on rails, designed to displace the station and set it in line with the other station when a replacement is to be made, the first of said stations bearing the guide consisting of segments of bar guide, to be replaced either partially or totally, the said segments being linked to a supporting structure, and the second of the said stations bearing a platform provided with means for hooking and extracting the segments of the guide. The fast-changing device also comprises means of positioning of the guide with respect to the ingot mould and means of hooking and translation of the guide from one of the stations to the other.

Alternatively, both of the stations may be mobile. Another possibility is for there to be two stations provided with platform and means for hooking and extraction of the guide segments, both stations being mobile or fixed.

The mobile station (or the set of mobile stations) can be mounted on rectilinear or curved rails so as to move parallel to one another or turn between the casting position and the position in line with the station that receives the guide segments. In a continuous-casting plant comprising an ingot mould connected to oscillating means (or oscillator) and set above a line for guiding the bar extracted from the ingot mould, the process for replacement of the bar guide according to the present invention comprises in sequence and combination, in a relation of co-operation, the operations of (i) setting up a first station and a second station, at least one of which being mobile, the first of the said stations comprising the guide consisting of segments of bar guide, to be replaced, the segments being hooked to a supporting structure, and the second of said stations having a platform equipped with means for hooking and extracting the guide segments; (ii) detecting the need for replacing at least part of the guide segments; (iii) translating said mobile station to align it head on with the other station; (iv) displacing the guide segments from the first station to the second station; (v) replacing at least part of the said guide segments; (vi) displacing said segments partially or totally replaced into the original station; (vii) bringing back the plant into the original working position, i.e., with the guide aligned both to the ingot mould and to the extraction and straightening assembly. The mobile station may be moved by displacing it transversely with respect to its own longitudinal axis, or else by rotating it.

Being in the position for changing the guide segments, the mobile station aligned head on with the fixed station, the guide segments are extracted from the bottom of the station containing them, one after another (and shifted to the empty station), so as to facilitate their further inspection and dismantling.

As an alternative to what is described above, the ingot mould may be displaced together with the guide. In addition, ale the oscillator may be displaced together with the ingot mould.

BRIEF DESCRIPTION OF THE DRAWINGS

The present invention will now be described in greater detail with reference to the attached plates of drawings which show, schematically, embodiments to provide non-limiting examples of the invention In the attached plates:

FIG. 4 is a schematic plan view of a plant according to FIG. 2, with the supporting structure aligned with the straightener assembly;

FIG. 5 is a schematic plan view of the same plant as that of FIG. 4, in which, however, the structure supporting the guide assembly is aligned with a platform for replacement of the guide assembly;

DETAILED DESCRIPTION OF THE INVENTION

Figure 1:
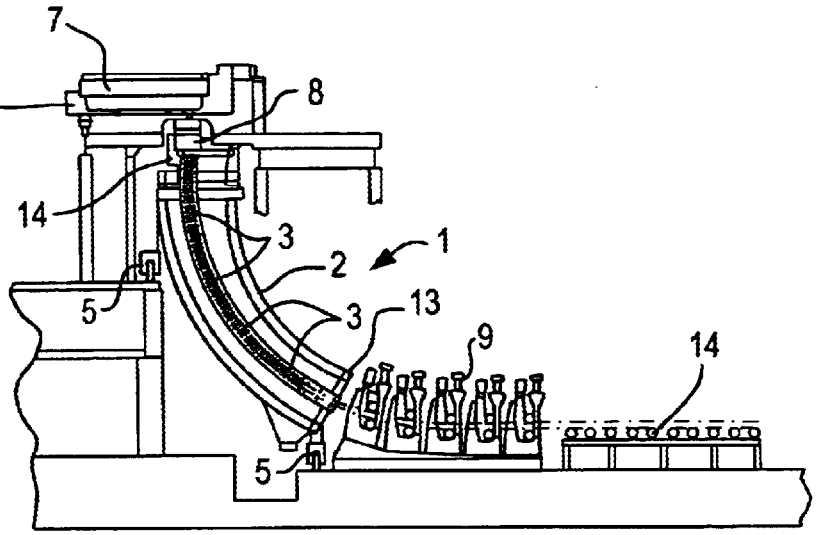
FIG. 1 represents a schematic side elevation of a device according to the present invention, in which the supporting carriage of the guide is mobile on rail means, to and in which the guide assembly is aligned head on with the straightener assembly.
Figure 2:
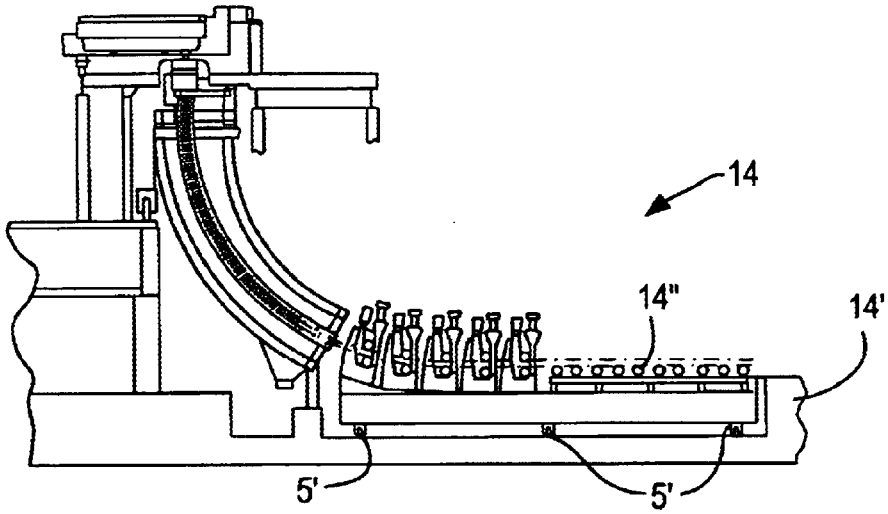
FIG. 2 represents a schematic side elevation altogether similar to that of FIG. 1, except that it is the straightener assembly and possibly part of the roller table (with the adjacent parallel platform equipped for replacement of the guide segments-not shown) that is mobile on rail means.

In relation to the attached Figures, taken in sequence starting from FIG. 1 to FIG. 6*b*, the device according to the present invention comprises in a continuous-casting plant 1, a tundish carriage 6 which carries a tundish 7 in which liquid metal, in particular molten steel, is fed, from a ladle (not shown). From the tundish 7 the steel is sent into an ingot mould 8 supported by an oscillator 14. In the ingot mould 8 a continuously cast body is formed, hereinafter referred to as bar, which is continuously extracted from the ingot mould and sent to a guiding and secondary-cooling area, and subsequently to the extraction and straightening plant 9, and then to the next plant, namely the cutting plant (not shown).

The guide line 2 comprises means (not shown) of positioning and alignment with respect to the ingot mould and consists of a number of guide segments 3, arranged in a known way by means of blocking systems (not shown) upon a supporting structure 13, which in this case is mobile in a direction transverse to the casting line, for example, by means of displacement 5.

The entire arrangement, comprising the guide line 2 with the corresponding guide segments 3, the supporting structure 13, which being mobile is referred to as the supporting carriage, the displacement means 5, and the connected auxiliary devices comprising rail means 5''' (FIG. 6), constitutes the first of the stations of the device according lo the present invention.

Figure 3:
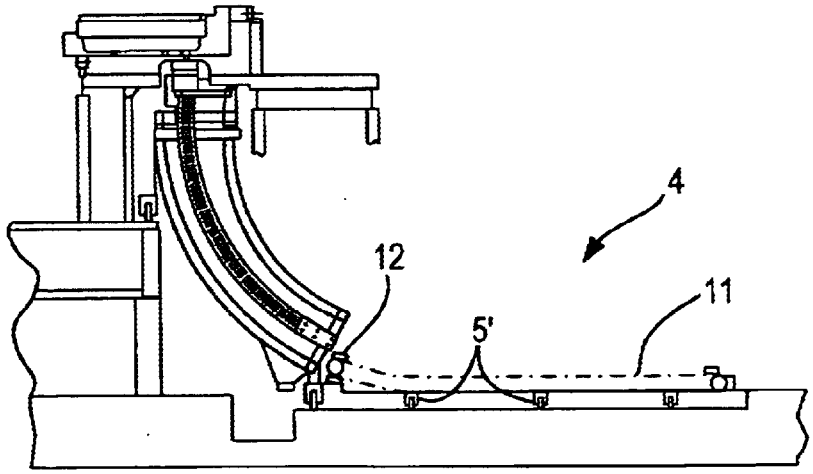
FIG. 3 represents a schematic side elevation of a device according to the present invention, in which the two stations have been brought into alignment head on to each other (it is To be noted that the rail means for displacement of the mobile station are here not shown, precisely in order to indicate that it may be either the supporting carriage or, indifferently, the straightener assembly with the platform equipped for replacement of the guide segments, and possibly part of the roller table, that moves)

Set parallel to the extraction and straightening assembly 9, which in this case is fixed, and at the level of the lowest part of the guide line 2, is the second station, which is also fixed, comprising at least one equipped platform 4 that includes means of displacement and hoking, 11 and 12, of the guide line (FIG. 3).

In line with the extraction and straightening assembly there is the roller way 14.

The guide segments 3 may be made up of pairs of rollers, or pairs of metal loop strips, suitably cooled down.

The device is completed, in a way known per se, by means (not shown) for instance small cranes or overhead travelling cranes for removing from the platform 4 segments 3 that are damaged or worn out and for replacing them with segments reconditioned in a separate workshop.

In a variant of the invention, advantageously used for one-line casting plants, it is possible to get the equipped platform 4 to move (FIGS. 2, 4 and 5), for example on rail means 5'', so as to bring it into alignment with the guide-supporting structure, which in this case is fixed, for extracting the segments. In this variant, the roller way 14 may be made up of a fixed part 14' and a mobile part 14'', linked to the extraction and straightening assembly 9.

The second station according to the present variant, in addition to the platform 4 equipped with the displacement and hooking means 11 and 12, also comprises the extractor and straightener assembly 9 and possibly the mobile part 14' of the roller way.

In both variants it is also possible to use two platforms 4, set parallel to each other and mobile (FIGS. 4, 5 and 6), so as to be alternately aligned with the supporting carriage 131 or else fixed, in which case it is the supporting carriage 13 that moves to align itself with one of the platforms. It is also possible to keep the extractor and straightener assembly 9 fixed, and get the carriage 13 and possibly the platform (or platforms) 4 to move, respectively on rail means 5''' and 5''.

If two equipped platforms 4 are used, it is possible to set them alongside one another, one of the platforms being empty and the other carrying an entire guide. This makes replacement of the guide even faster, but obviously involves a somewhat higher cost.

When there is the need to replace at least some of the guide segments 3, the casting is interrupted, and the operations required for eliminating the entire cast body between the ingot mould and the extractor are carried out. Subsequently, for example with reference to FIGS. 1 and 6, the supporting carriage 13 is displaced along the rail system 5''' until it is brought into head-on alignment with the platform 4 (FIG. 3). In this position, the means 11 for displacing the guide segments 3 are moved until the hooking means 12 engage with the set of guide segments 3. It is now possible to free tie segments themselves from the carriage 13 and finally to drag them onto the platform 4, using the hooking and displacement means 12 and 11, respectively. Now the segments 3 set on the platform 4 are inspected and rapidly replaced.

Figure 3B:
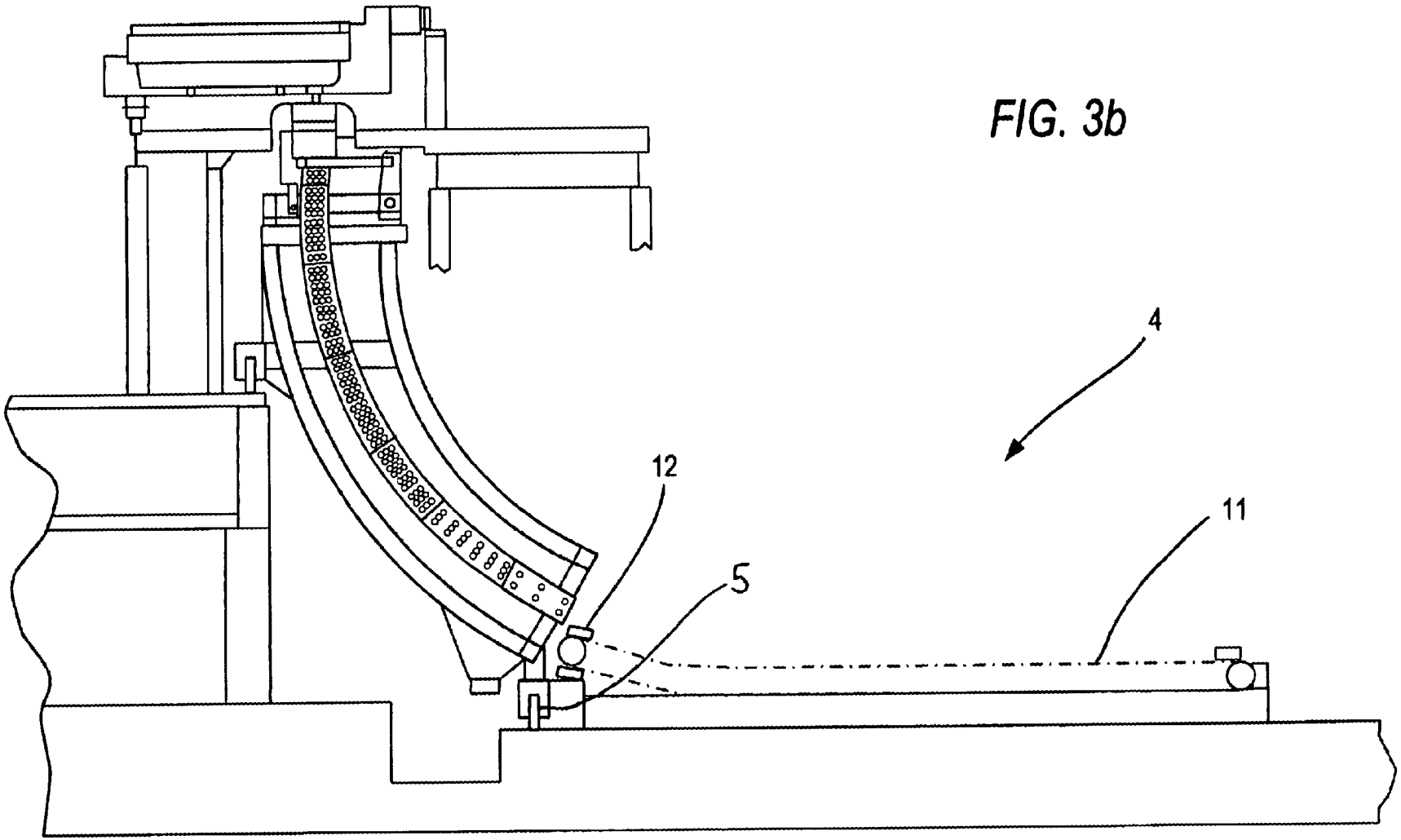
FIG. 3*b* represents a schematic side elevation of another embodiment of the device according to the present invention, in which the supporting carriage is displaceable along rails and the platform is fixed.
Figure 6B:
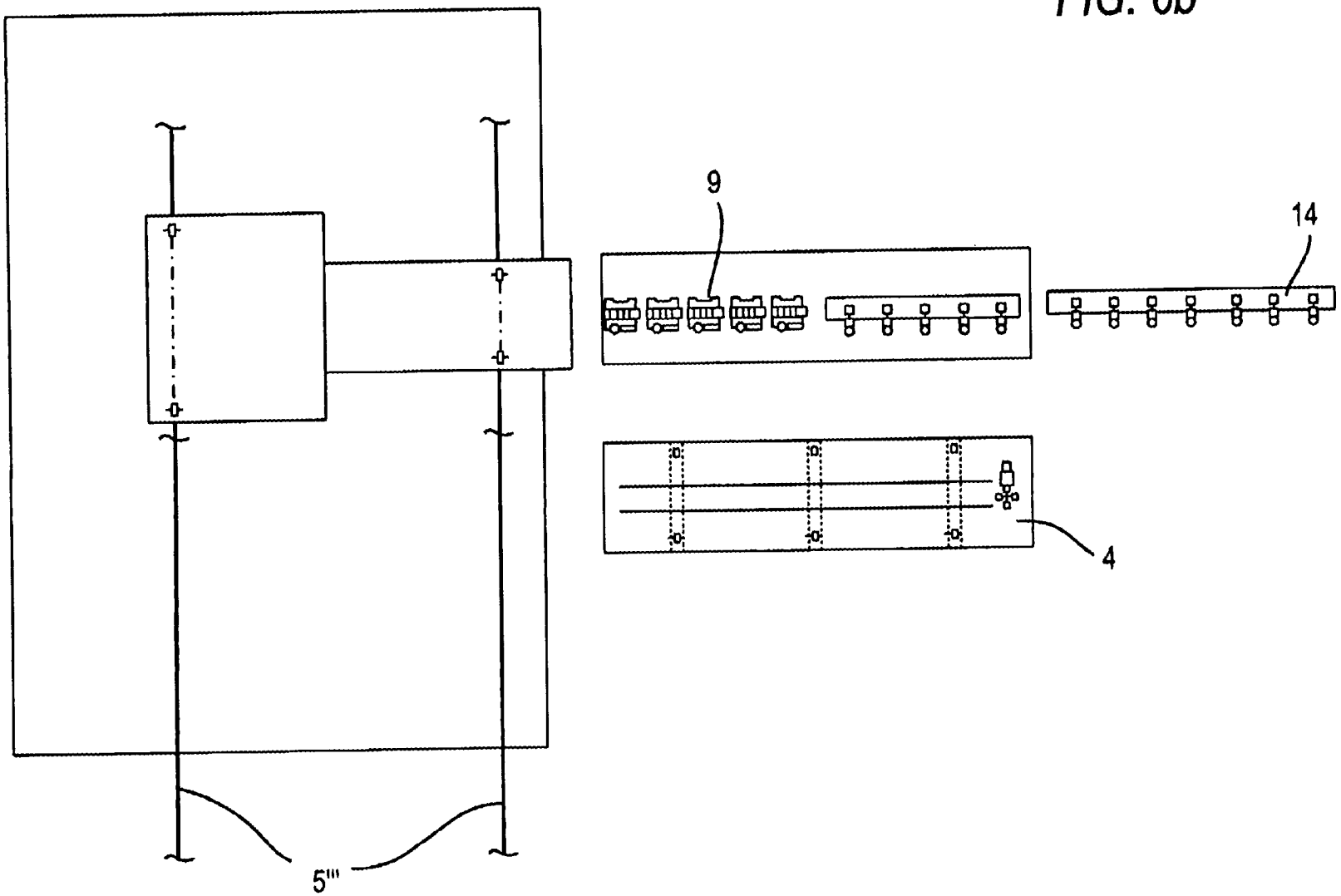
FIG. 6 is a schematic plan view of the plant of FIG. 3, in which the straightening and extraction assembly is fixed, and the supporting structure is mobile, as likewise may be mobile the equipped platform or platforms.

In the embodiment according to the invention, shown in FIGS. 3*b* and 6*d*, where parts correspondent to those of the embodiments disclosed above are indicated with the same numerals, only one platform 4 is provided, which fixed on the soil or shop pavement. The supporting carriage is mobile along rails and allows positioning alternatively either in alignment with the straightening assembly 9 or with the platform 4.

If necessary, also the ingot mould 8 can be moved together with the connected guide. Also the oscillating bench 14 can be displaced together with the ingot mould 8 and the guide 2. According to the present invention, it is possible to reduce the time necessary for replacement of the bar guide from 180 minutes, which is the time generally necessary for the longest interventions, to less than 30 minutes, with evident advantages in terms of productivity and general plant economy.

What is claimed is:

1. Apparatus for use in the maintenance of a continuous-casting bar production plant to facilitate the rapid inspection and maintenance of the bar guide line, said bar guide line comprising a plurality of guide segments operably arranged on a supporting structure and defining a first station, an outlet portion of said bar guide line of said first station being operably aligned in a first operating position with a bar extraction and straightening assembly, the apparatus comprising:

(a) a second station that includes at least one service platform having a guide bar receiving surface that is horizontally aligned with the outlet portion of the bar guide line, and, service means cooperatively associated with said at least one service platform for engaging and removing at least a portion of the plurality of guide segments from an operable position on the supporting structure to an exposed position on the at least one service platform of the second station and (b) rail means extending between said first and second stations;

(c) displacement means for moving said first station relative to said second station on said rail means, said movement being from the first operating position in which the stations are not aligned to a second service position in which the stations are in head-on alignment, whereby the first and second stations are rapidly disposed into alignment upon termination of bar production for removal, inspection and maintenance of all or a portion of the guide segments.

2. Apparatus according to claim 1 in which said first station is provided with displacement means and said second station is fixed.

3. Apparatus according to claim 2 in which said rails comprise rectilinear rails.

4. Apparatus according to claim 3 in which said second station comprises two platforms, each platform being equipped with means for engaging and removing the guide elements.

5. Apparatus according to claim 4 in which the two stations are supported on rails.

6. Apparatus according to claim 2 in which said rails are curved rails.

7. Apparatus according to claim 6 in which said second station comprises two platforms, each platform being equipped with means for engaging and removing the guide segments.

8. Apparatus according to claim 7 in which the two stations are supported on rails.

9. Apparatus according to claim 1 in which said first station is fixed and said second station is provided with displacement means.

10. Apparatus according to claim 9 in which said second station also comprises the bar extraction and straightening assembly.

11. Apparatus according to claim 10 in which said second station is part of a roller table.

12. Apparatus according to claim 1 in which said rails comprise rectilinear rails.

13. Apparatus according claim 12 in which said second station comprises two platforms, each equipped with means for engaging and removing the guide segments.

14. Apparatus according to claim 13 in which both of the first and second stations are installed on rails.

15. Apparatus according to claim 1 in which said rails are curved rails.

16. Apparatus according to claim 15 in which said second station comprises two service platforms, each platform being equipped with means for engaging and removing the guide segments.

17. Apparatus according to claim 16 in which both of the first and second stations are installed on rails.

18. A method for the inspection and maintenance of bar guide segments in a continuous-casting plant for the production of metal bar stock, the plant including an ingot mold, an oscillator and a bar guide assembly comprising a plurality of guide segments, the method comprising:

(a) providing a first station comprising the bar guide assembly;

(b) providing a second service station that includes at least one service platform equipped with means for engaging and removing at least a portion of the plurality of guide segments;

(c) providing displacement means that allow relative movement of the first and second stations to a head-on aligned position;

(d) moving the first and second stations relative to each other to a head-on aligned position;

(e) engaging at least a portion of the plurality of guide segments in the bar guide assembly;

(f) removing a predetermined number of the engaged guide segments from the bar guide assembly to a position on the at least one service platform;

(g) performing any necessary maintenance on the removed guide segments;

(h) moving the guide segments to an operable position in the bar guide assembly; and (i) moving the first and second stations relative to each other so that the stations are not aligned.

19. The method of claim 18 in which said first station is moved into alignment with the second station.

20. The method of claim 19 in which the ingot mold is displaced with the bar guide assembly.

21. The method of claim 20 in which the oscillating bench is displaced with the bar guide assembly and the ingot mold.

22. The method of claim 18 in which said first station is moved into alignment with the first station.

23. The method of claim 22 in which said second station further comprises a bar extraction and straightening assembly.

24. The method of claim 23 in which said second station forms a part of a roller table.

25. The method of claim 18 which includes the further steps:

(j) providing with the second station a second replacement platform on which are positioned a plurality of replacement guide segments arranged to replace all or a predetermined number of the plurality of guide segments in the bar guide assembly of the first station;

(k) after step (f), removing the service platform from the head-on aligned position with the first station;

(1) aligning the first station and the replacement platform of the second station; and (m) completing steps (h) and (i).

26. The method of claim 25 in which the platforms are reciprocally displaced from alignment with the second station on rails.

* * * * *